United States Patent [19]

Bright

[11] 3,938,837

[45] *Feb. 17, 1976

[54] SAFETY LOCK FOR ENCLOSURES

[76] Inventor: William L. Bright, 0605 SW. Curry St., Portland, Oreg. 97201

[ * ] Notice: The portion of the term of this patent subsequent to Feb. 12, 1991, has been disclaimed.

[22] Filed: Dec. 3, 1973

[21] Appl. No.: 421,446

Related U.S. Application Data

[62] Division of Ser. No. 230,223, Feb. 29, 1972, Pat. No. 3,791,683.

[52] U.S. Cl. ..... 292/149; 292/155

[51] Int. Cl.[2] ..... E05C 1/04

[58] Field of Search ..... 292/32, 33, 42, 43, 145, 292/147, 148, 149, 155

[56] References Cited

UNITED STATES PATENTS

| | | | |
|---|---|---|---|
| 524,146 | 8/1894 | Hottes | 292/149 |
| 3,083,046 | 3/1963 | Eberly | 292/76 |
| 3,791,683 | 2/1974 | Bright | 292/32 |

*Primary Examiner*—Robert L. Wolfe
*Attorney, Agent, or Firm*—Eugene M. Eckelman

[57] ABSTRACT

A safety lock for enclosures having a first lock portion attached to the first of two members to be locked together. This lock portion includes a bolt rotatable for accomplishing a locking function. The bolt has a head of non-conventional shape. A second lock portion is attached to the other of the members to be locked together and is engageable by the bolt. The first lock portion includes a protective wall peripherally surrounding the bolt head and open at its outer end. The surrounding wall defines a socket which is at least as deep as the thickness of the bolt head to prevent side engagement of the bolt head and which is of greater diameter than the bolt head to permit removal of the bolt by a special wrench inserted through the open end of the protective wall. The second lock portion in one embodiment includes a pin having a radial notch intermediate its ends engageable by the bolt to provide a more positive lock. Also, in some embodiments, the pin projects beyond the first lock portion and receives a padlock or the end of the pin may project into a socket member to conceal the end thereof. A further locking feature may employ a spring acting on one of the lock portions with a force great enough to prevent children from opening the lock even though other fastening means of the lock are released.

1 Claim, 8 Drawing Figures

FIG. 3
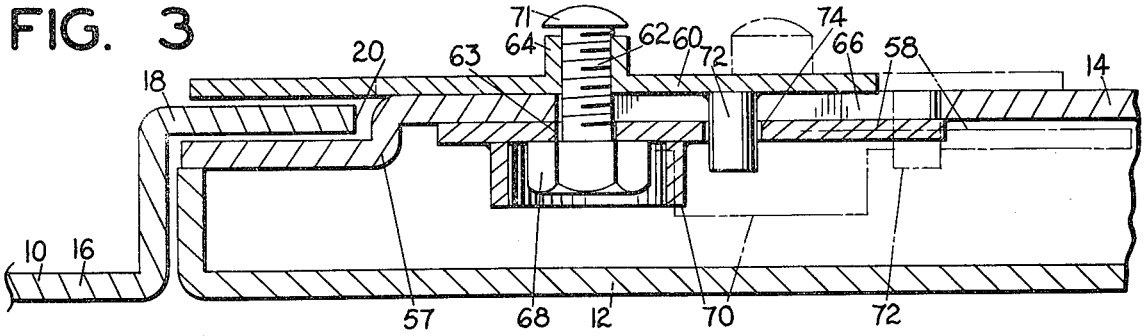
FIG. 5
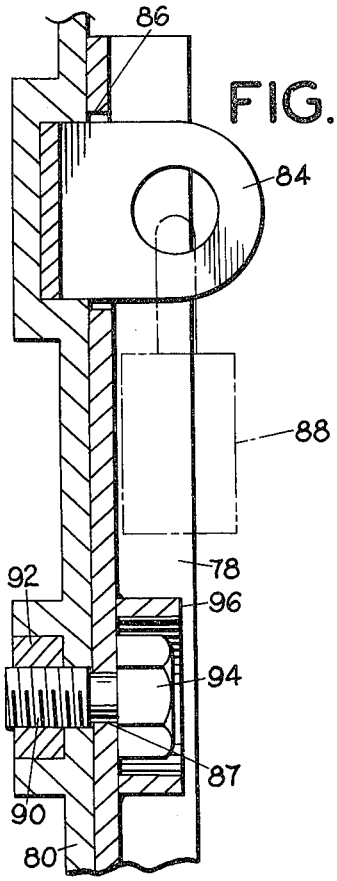
FIG. 2
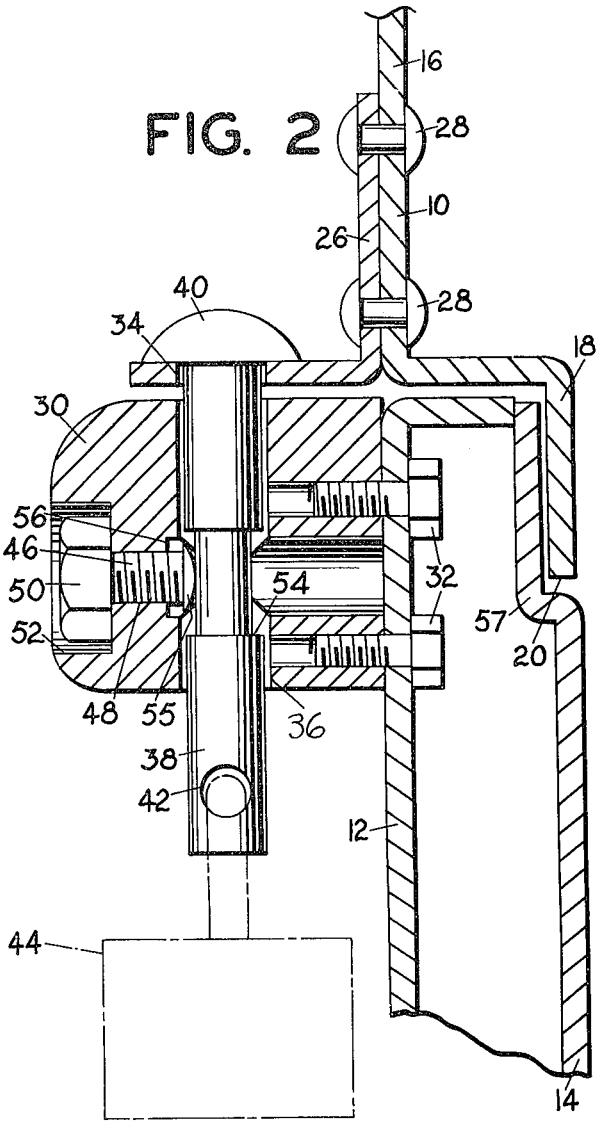
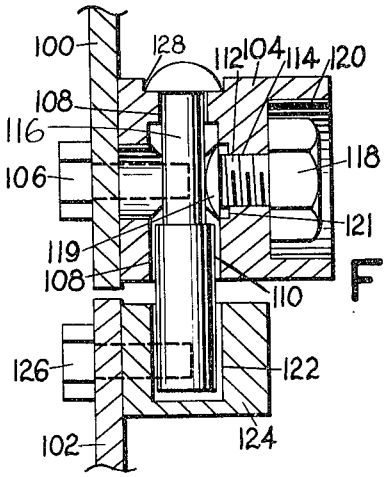
FIG. 6

SAFETY LOCK FOR ENCLOSURES

REFERENCE TO PRIOR APPLICATIONS

This application is a division of application Ser. No. 230,223, filed Feb. 29, 1972, for Safety Lock For Enclosures, now U.S. Pat. No. 3,791,683 issued Feb. 12, 1974.

BACKGROUND OF THE INVENTION

This invention relates to new and useful improvement in safety locks for enclosures.

Various types of locking means have been proposed for preventing unauthorized access to enclosures for electrical equipment and other types of enclosures. However, conventional locks can be knocked off or conventional fasteners can be opened with conventional tools. When the enclosure contains dangerous equipment or the like, such unauthorized tampering may expose the person to injury. In some instances, the unauthorized personnel may be children who do not understand the danger involved or who are not responsible for their actions. Thus, lock means are now demanded in the trade which provide a margin of safety against entrance into enclosures which contain dangerous equipment even though entrance may be sought by unauthorized personnel.

SUMMARY OF THE INVENTION

According to the present invention and forming a primary objective thereof, lock means are provided for enclosures utilizing specially shaped bolt means which cannot be opened by conventional tools but which require special tools, whereby a child or other unauthorized person who may tamper with the lock means cannot ordinarily gain access to the enclosures.

A more particular object of the present invention is to provide lock means of the type described including a bolt having a head of non-conventional shape for requiring a special tool and also including a protective wall for the head of the bolt which prevents the bolt head from being engaged from the side, the protective wall being of greater diameter than the bolt head to permit such head to be engaged endwise by a special socket wrench corresponding in shape to the shape of the bolt head.

It is another object to provide in an embodiment of the invention, a combination of said bolt lock means and a locking latch or pin adapted to receive a padlock, thus providing a double locking feature. Further, the latch may be spring loaded with a force such that even though the double lock means is released, a child could still not operate the latch.

A further object is to provide in another embodiment of the invention a combination of said bolt lock means and a locking pin having a radial notch engageable by the locking bolt to provide a more positive lock, and further yet to provide a locking pin of a length to project through a lock portion and be engaged in a socket which conceals the end of the pin to prevent the pin from being driven out.

Still another object is to provide lock means on a double door enclosure, with each door having a locking arrangement utilizing a bolt with a head of non-conventional shape and a protective wall for such bolt head.

The invention will be better understood and additional objects and advantages will become apparent from the following description taken in connection with the accompanying drawings which illustrate preferred forms of the device.

BRIEF DESCRIPTION OF THE DRAWINGS

FIG. 2 is an enlarged vertical fragmentary sectional view taken on the line 2—2 of FIG. 1;

FIG. 3 is an enlarged horizontal fragmentary sectional view taken on the line 3—3 of FIG. 1;

FIG. 5 is an enlarged vertical fragmentary sectional view taken on the line 5—5 of FIG. 4;

FIG. 6 is a vertical sectional view through another form of lock embodying features of the present invention.

DETAILED DESCRIPTION OF PREFERRED EMBODIMENTS

Figure 1:
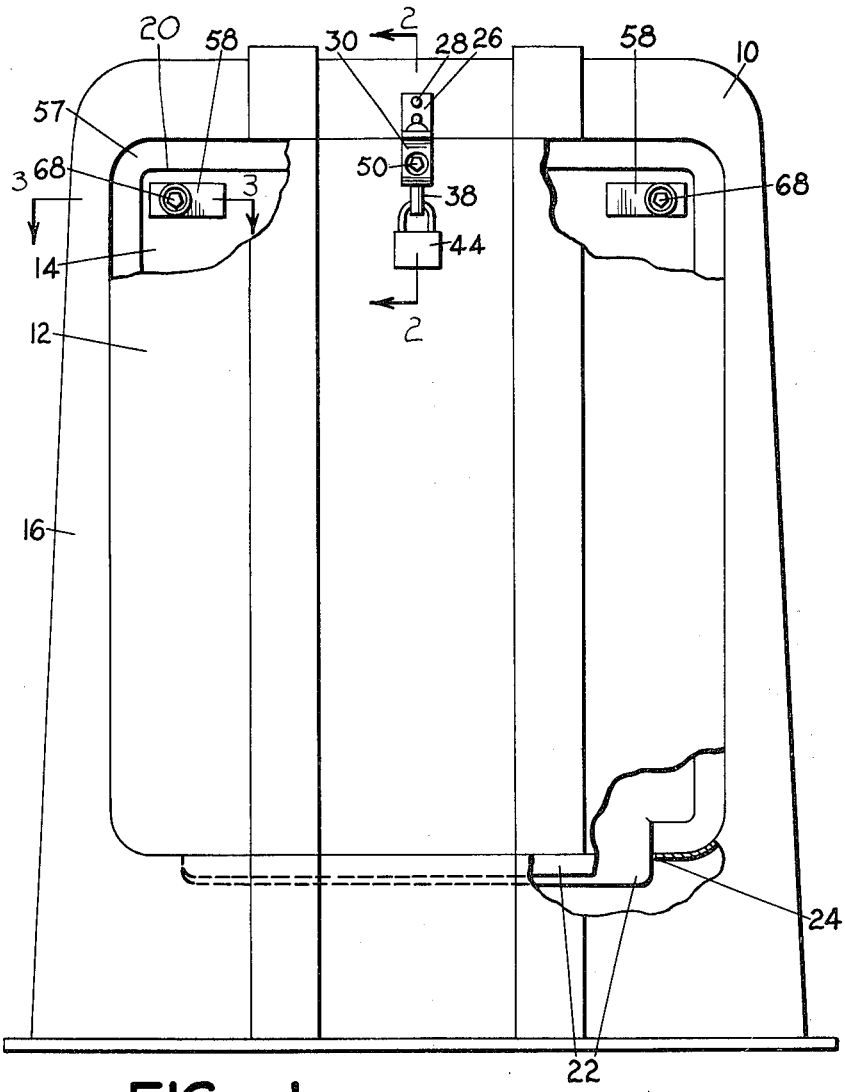
FIG. 1 is a front elevational view, partly broken away, of an enclosure utilizing lock means of the present invention.
Figure 4:
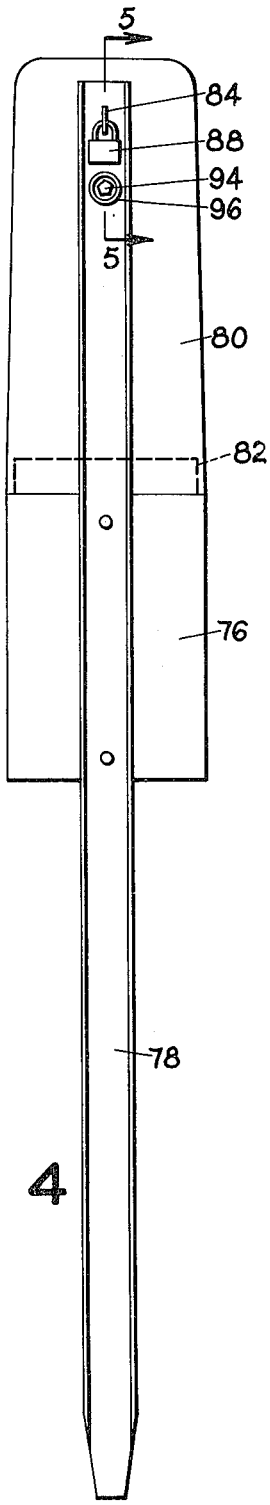
FIG. 4 is an elevational view of a second form of enclosure with which the present invention may be used.

FIGS. 1 and 4 illustrate two forms of enclosures with which the present locking means may be employed. It is to be understood, however, that the enclosures shown are merely exemplary and that the present invention may be employed with many other types of enclosures. With reference first to FIGS. 1, 2 and 3 the numeral 10 designates an enclosure for electrical equipment or the like having an outer door 12 and an inner door 14. The front wall 16 has an inwardly offset portion 18 which receives the inner and outer doors to make a substantially flush front surface for the enclosure. The door opening 20 is provided in the inwardly offset portion 18, and each of the doors 12 and 14 has bottom tongues which fit in cutout portions 24, FIG. 1, at the bottom portion of the opening so that in order to open either of the doors they first must be swung out from the top and then lifted up. For maximum safety against unauthorized access, both doors have safety locks, now to be described.

With particular reference to FIGS. 1 and 2, the safety lock means for the outer door comprises a right angle lock portion 26 secured to the front wall of the enclosure immediately above the inwardly offset portion 18. The securement of the lock portion 26 to the housing is accomplished by suitable tamperproof means 28 such as rivets. Secured to the door 12 is another lock portion 30. This latter lock portion is secured to the upper portion of the door by suitable fastening means 32 extending from the inner side of the door and engaging the rear portion of said lock portion. Lock portion 30 is aligned vertically with the lock portion 26, and the two lock portions have bores 34 and 36, respectively, in vertical alignment for receiving a lock pin 38 having a head 40 at its upper end and an aperture 42 at its lower end. The aperture 42 is arranged to receive a padlock 44, and it is apparent that with the padlock in place, the pin cannot be removed. The door 12 is thus securely locked.

To provide a double locking feature, a bolt or setscrew 46 is threadedly engaged in a threaded bore 48 which extends transversely in from the front of the lock portion 30 and intersects the bore 36. The bolt 46 has end abutment with the side surface of the pin 38 to lock the pin securely against longitudinal movement. Bolt 46 has a head 50 received in a counterbore or socket portion 54 communicating with the bore 48. Socket 52 has a greater depth than the thickness of the head 50 so that the head 50 cannot be engaged laterally by a wrench or other tool.

The head 50 is of unconventional shape so that wrenches or other tools marketed through normal channels cannot obtain a grip thereon. One such shaped head would be five sided or pentagonal shape which as is well known cannot be engaged endwise by wrenches which are in normal use. Operating personnel would of course have special socket wrenches for engaging the head 50. Unauthorized personnel would be discouraged because of the tamper-proof nature of the lock. The diameter of the socket 52 is sufficiently greater than the outer diameter of the head 50 to allow the special wrench to be engaged endwise with the head.

The locking pin 38 has a peripheral notch 54 in the area in which it is engaged by the end of bolt 46. Such notched engagement of the lock pin 38 provides a more positive connection in a case where the padlock may have been knocked off since the pin cannot be pounded out, at least with any facility. The inner end of bolt 46 terminates in an enlargement or swedged portion 55 to prevent removal of the bolt 50 so that it will not become lost. The enlarged end 55 operates in a counterbore 56 of bore 48 so that the bolt can be backed out a sufficient distance to allow the pin 38 to be removed.

Thus, according to the structure thus far described, not only is the bolt head of unconventional shape and difficult to rotate but also it is countersunk so that it cannot be engaged laterally. Such locking arrangement which prevents unauthorized removal of locking pin 38 is in addition to the padlock.

FIGS. 1 and 3 show lock means for the inner door 14. To illustrate such lock means, the inner door has offset portions 57 at the sides which engage a portion of offset 18 of the front wall of the enclosure so that the main portion of the door 14 is substantially flush with the inner vertical plane of offset 18. Two individual locks are provided, one on each side. Each of the lock means comprises a front clamp plate 58 and a rear clamp plate 60 which extends beyond the front clamp plate at one side, namely, that side adjacent to the outer edge of the door. These clamp plates are adapted to be clamped securely against opposite sides of the door 14 for secured positioning but also are adapted to be unclamped for movement to an unlocked position. Such is accomplished by a bolt or screw 62 passing freely through an aperture 63 in clamp plate 58 and threadedly engaged in a threaded boss 64 on the rear side of clamp plate 60. The bolt 62 extends freely through a laterally elongated slot 66 in wall 14 arranged such that upon loosening the bolt, both plates 58 and 60 in the pair are slidable laterally. In the laterally outward or locking position of the clamp plates, the clamp plate 60 extends behind the offset portion 18 so that the door is held closed. On the other hand, if the clamp plates are moved to the right as shown in phantom lines in FIG. 3, the clamp plate 60 clears the inner edge of opening 20 so that the door can be opened.

As in the structure of FIG. 2, the locking bolts 62 have odd shaped heads 68, such as pentagonal shape, and are surrounded by peripheral walls 70 which prevent lateral engagement of the heads 68 by a wrench. The walls 70 have diameters larger than the heads 68 so that a socket wrench can engage the heads endwise. The ends of bolts 62 are swedged at 71 to prevent the bolts from being completely removed and possibly lost.

Clamp plates 60 have integral pins 72 which project through slots 66 in the door 14 and through openings 74 in clamp plates 58. These pins hold the two clamp plates in the pairs in parallel relation.

The structure described with relation to FIGS. 2 and 3 will thus provide door means which are almost impossible to open except of course by authorized personnel. Even though the outer door could be broken off, the inner door is still intact.

FIGS. 4 and 5 show the application of principles of the present invention to an enclosure having a housing base portion 76 permanently attached to a ground supporting post 78. An enclosure 80 is supported on the base portion 76, such enclosure having a tongue engagement 82 with the base portion 76 such that to remove the enclosure, it must be lifted upwardly. The post 78 extends upwardly above the base portion 76 and the enclosure has an eye member 84 secured thereto, this eye member projecting through an opening 86 in the post 78 and receiving a padlock 88 for providing a first lock.

To provide a safety lock, and utilizing the principles of the present invention, a bolt 90 passes freely through an aperture 87 in the post 78 and is engaged with a threaded portion 92, such as a nut, secured to the inside of the enclosure 80. Bolt 90 has an odd shaped head 94 as in the other embodiments for engagement by a special wrench, and such head is protected by a peripheral wall 96 which prevents lateral engagement of the head by a wrench. Upon removing the bolt 90, and the padlock 88, the enclosure 80 can be tilted slightly away from the post and then lifted away from the tongue engagement 82 for removal from its base 76.

In FIG. 6, which shows another embodiment of the invention, a pair of members to be locked together are designated by the numerals 100 and 102. A lock portion 104 is secured to the member 100 by fastening means 106 extending from the inside of the enclosure and has a vertical bore 108 for receiving a locking pin 110. A lock bolt or setscrew 112 is threadedly mounted in a threaded bore 114 extending in from the front of the lock portion 104 and is adapted to engage the lock pin 110 for holding it in place, the lock pin having a peripheral notch 116 in the area of engagement by the lock 112. Bolt 112 has an odd shaped head 118 as in the other embodiments and the lock portion 104 has a socket 120 which surrounds the head 118 to prevent it from being engaged laterally by a wrench. Bolt 112 also has an enlarged inner end 119 to prevent complete withdrawal of the bolt, such enlarged end operating in a counterbore 121 of bore 114 to permit removal of pin 110.

The locking pin 110 projects beyond the bottom of lock portion 104 and extends into an upwardly opening socket portion 122 of another lock portion or protector member 124 secured to the member 102 by fastening means 126 extending from the inside of the member 102. The socket 122 is closed at the bottom to prevent unauthorized persons from driving the pin up. When it is desired to open the member 102 relative to the member 100, the bolt 112 is backed off and the pin 110 raised sufficiently to clear the top of the member 124.

The parts 100 and 102 can then be separated.

In a preferred arrangement, the peripheral notch 116 is provided adjacent to the upper end of the pin 110 and the portion of the opening 108 which receives such upper portion of the pin is smaller in diameter than the portion which receives the lower portion of the pin so that even though the pin can be raised sufficiently to be released from the block 124, it cannot be completely displaced from the hasp member, thus preventing the pin from becoming lost. The upper end of bore 108 terminates in a counterbore 128 to partially receive the head of lock pin 110 so that it is impossible for an unauthorized person to engage the underside of the pin with a prying tool.

Figure 7:
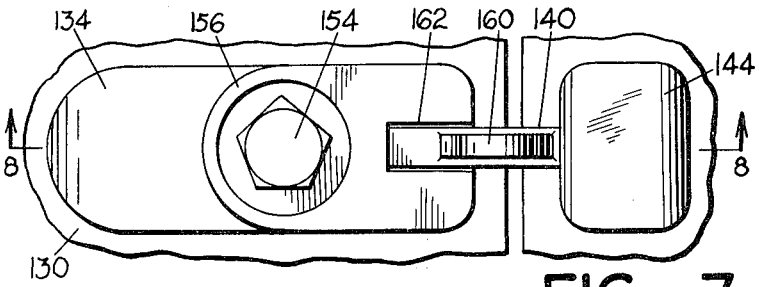
FIG. 7 is a fragmentary elevational view of still another form of lock of the invention.
Figure 8:
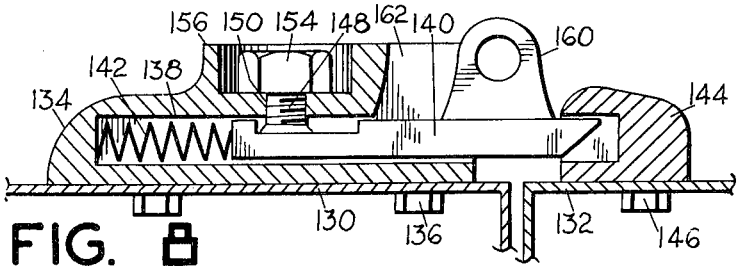
FIG. 8 is a sectional view taken on the line 8—8 of FIG. 7.

FIGS. 7 and 8 show another arrangement of the invention wherein a pair of members to be locked together are designated by the numerals 130 and 132. A lock portion 134 is secured to member 130 by fastening means 136 extending from the inside of member 130. This lock portion has an inner longitudinal slot 138 for slidably receiving a latch member or bolt 140. A compression spring 142 is housed in the inner end of slot 138 and urges the latch member outwardly into locked relation with another lock portion 144 secured to member 132 as by fastening means 146. To release the latch member 140 from lock portion 144, it must be retracted against the force of spring 142 which according to the invention is of sufficient strength that a child could not operate the latch member in its opening movement.

The embodiment of FIGS. 7 and 8 has double lock means in addition to the safety locking feature resulting from spring 142. One such lock means comprises a lock bolt or screw 148 threadedly engaged in a bore 150 in lock portion 134. The lock bolt 148 is adapted to engage the latch member 140 for holding it in place, the latch member having a recess or socket 152 engageable by the end of the bolt to prevent forced movement thereof. Bolt 148 has an odd shaped head 154 as in the other embodiments, and the lock portion 134 has a socket 156 which surrounds the head 154 to prevent it from being engaged laterally by a wrench. Bolt 148 has an enlarged inner end 158 to prevent complete withdrawal thereof.

Another lock means in the embodiment of FIGS. 7 and 8 comprises an eye member 160 forming an integral part of latch member 140 and projecting through a slot 162 in lock portion 134. The eye member 160 is arranged to receive a padlock, not shown, which prevents opening movement of the latch member. The structure just described thus has two locking functions, as well as the spring loaded feature of the latch member 140 for added safety.

It is to be understood that the forms of my invention herein shown and described are to be taken as preferred examples of the same and that various changes in the shape, size and arrangement of parts may be resorted to without departing from the spirit of my invention or the scope of the subjoined claims.

Having thus described my invention, I claim:

1. An enclosure comprising a. defining walls with at least one of said walls having a door opening therein and an inwardly disposed offset flange adjacent said opening parallel with said wall in which said opening is provided, b. a door in said opening having opposite face surfaces and having a portion thereof overlapping said flange in its closed position, c. a pair of clamp plates on opposite face surfaces of said door, d. said plates having a slidable mounted engagement on said door in an arrangement whereby one of said plates is movable into and out of overlapping relation with said flange on the opposite surface of said flange from the door, e. means defining a slot in said door, f. a bolt extending through said slot and threadedly engaged in one of said clamp plates, g. said bolt being arranged in a tightened condition to clamp said clamp plates together on said door in an overlapping position of said one clamp plate with said flange to lock the door and in a loosened condition to allow slidable movement of said clamp plates to a position wherein said one clamp plate is out of overlapping position with said flange to permit the door to open, h. the bolt associated with said clamp plates having a head of non-conventional shape whereby to be capable of rotation only by a special tool and thus non-removable by unauthorized persons, i. the clamp plate on the bolt head side including a protective wall portion peripherally surrounding said bolt head and open at the open end, j. said wall portion defining a socket which is at least as deep as the thickness of the bolt head to prevent side engagement of the bolt head by unauthorized persons and which is of greater diameter than said bolt head to permit removal of the bolt by a special tool inserted through the open end of the protective wall portion.

* * * * *